United States Patent [19]

Roberts

[11] Patent Number: 5,074,430

[45] Date of Patent: Dec. 24, 1991

[54] APPARATUS AND METHOD FOR REDUCING CONSUMPTION OF PAPER TOWELS

[76] Inventor: William C. Roberts, 600 Central Ave., Highland Park, Ill. 60035

[21] Appl. No.: 478,418

[22] Filed: Feb. 12, 1990

[51] Int. Cl.[5] ..... B65H 1/00

[52] U.S. Cl. ..... 221/44; 221/45; 221/63

[58] Field of Search ..... 221/33, 44, 45, 47, 221/48, 51, 55, 63, 312 R-312 C; 312/50, 60, 37

[56] References Cited

U.S. PATENT DOCUMENTS

| | | | |
|---|---|---|---|
| 803,624 | 11/1905 | Pope | 221/55 |
| 3,028,047 | 4/1962 | Tuft | 221/44 |
| 3,221,929 | 6/1962 | Riebel | 221/63 |
| 3,269,593 | 8/1966 | Lodewick et al. | 221/63 |
| 3,291,339 | 12/1965 | Hein | 221/45 |
| 3,935,965 | 2/1976 | Stevens | 221/48 |
| 3,994,417 | 11/1976 | Boedecker | 221/63 X |
| 4,535,912 | 8/1985 | Bonk | 221/63 X |

FOREIGN PATENT DOCUMENTS

| | | | |
|---|---|---|---|
| 865552 | 3/1971 | Canada | 221/44 |
| 917049 | 1/1963 | United Kingdom | 221/63 |

*Primary Examiner*—David H. Bollinger

*Attorney, Agent, or Firm*—Willian Brinks Olds Hofer Gilson & Lione

[57] ABSTRACT

An apparatus and method for retrofitting a paper towel dispenser by the insertion of a retrofit in the dispenser. The retrofit is mounted to the dispenser so as to reduce the dispensing orifice of the dispenser and thus prevents the user from extracting more than one towel at a time. The waste and expenditure associated with the dispenser is thereby significantly reduced.

8 Claims, 2 Drawing Sheets

APPARATUS AND METHOD FOR REDUCING CONSUMPTION OF PAPER TOWELS

BACKGROUND OF THE INVENTION

The present invention is directed to paper towel dispensers, in general, and to methods and apparatus for retrofitting such dispensers, in particular.

At the present time, many types of paper towel dispensers are available and in widespread use. Some of these dispensers are designed to be mounted horizontally, while others are designed to be mounted vertically. There are several problems with these existing dispensers, particularly the vertically mounted variety. For example, the wide dispensing orifice that is found in many modern day dispensers allows the user to reach his hand into the dispenser when attempting to extract paper towels. This often results in the user pulling out more paper towels than needed, thus leading to considerable waste. In addition, there is more cleanup involved since many of these wasted paper towels are not properly discarded. Further, because a user may be able to reach and touch undispensed towels, which may be subsequently used by another, potential problems concerning cleanliness and hygiene exist.

Accordingly, it is a primary object of the present invention to provide improved methods and apparatus for overcoming the aforementioned problems. In particular, it is a primary object of this invention to provide a retrofitted dispenser that reduces the consumption of paper towels in an efficient manner, while enhancing personal hygiene.

Further objects and advantages will become apparent from the following description and the accompanying drawings.

SUMMARY OF THE INVENTION

The present invention allows an existing paper towel dispenser to be retrofitted by the insertion of a rigid piece of material, either plastic or metal, for example, into the dispenser in such a manner as to narrow the dispensing orifice. Specifically, the dispenser to be retrofitted typically has a front portion, a back portion and a dispensing section. The dispensing section is located between the front and back portions of the dispenser. The dispensing section itself has a front member and a back member. These two members are typically joined so that a relatively large dispensing orifice exists therebetween. These two members need not, however, be separate pieces; they may be one piece. The dispensing section also has an interior surface and an exterior surface. The interior surface is located on the inside of the dispenser such that the stacked paper towels rest against the interior surface. The exterior surface is that surface which is exposed and with which the user makes contact. The retrofit is attached to the interior surface of either the front or back member. It may be attached in any conventional manner. The retrofit restricts the existing orifice so that only one paper towel may be extracted at a time.

The advantages of the present invention are numerous. Primarily, the amount of paper towels consumed is significantly reduced resulting in substantial cost savings. In addition, the cleanup caused by scattered unused paper towels is eliminated because only one sheet can be dispensed at a time. Also, the retrofitted dispenser is more hygienic because the user cannot reach into the dispenser and touch undispensed paper towels which may be used by another. The paper towels are also fully opened when dispensed, thus eliminating the inconvenience of trying to unfold the towels with wet hands.

In one aspect of the invention, an apparatus for retrofitting a paper towel dispenser is provided having a retrofit with an opening narrower than the dispenser's existing dispensing orifice and means for mounting the retrofit to the dispenser.

In another aspect of the invention, a method for retrofitting a paper towel dispenser is provided wherein a retrofit is mounted to the dispenser.

BRIEF DESCRIPTION OF THE DRAWINGS

Exemplary embodiments of the invention summarized above are shown in the accompanying drawings wherein.

DETAILED DESCRIPTION OF THE PREFERRED EMBODIMENT

Figure 1:
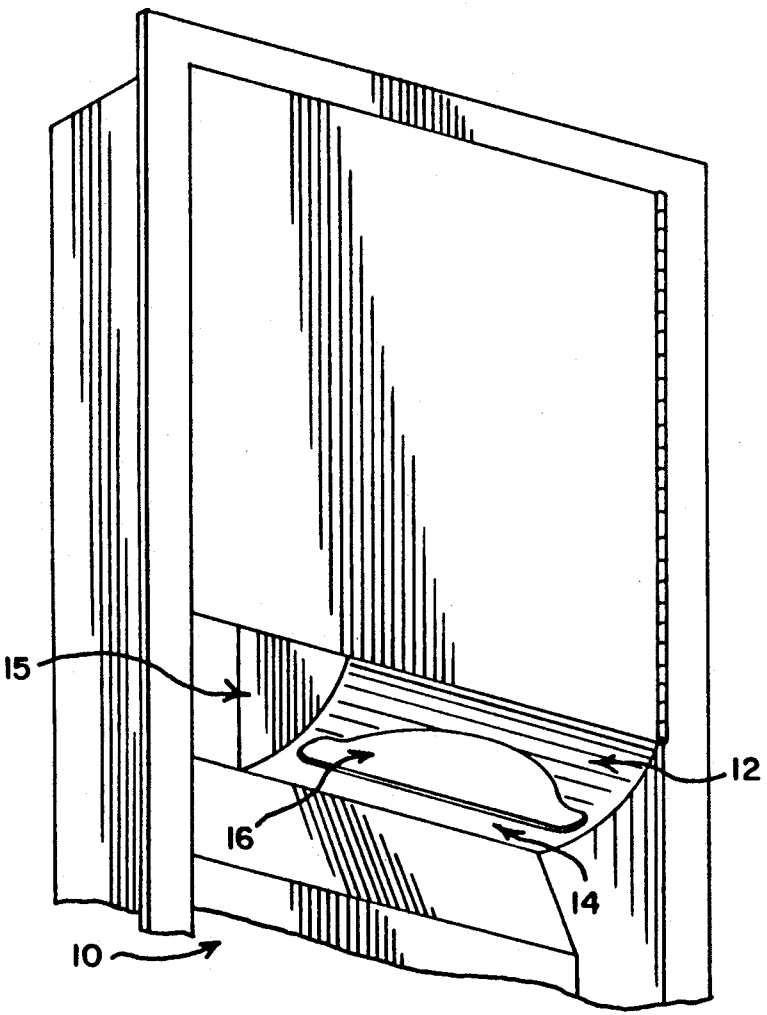
FIG. 1 PRIOR ART
FIG. 1 is a perspective view of an existing prior art paper towel dispenser.

FIG. 1 illustrates a perspective view of an existing paper towel dispenser 10 having a dispensing section 15. Dispensing section 15 includes a front member 12 and back member 14 which define the relatively large dispensing orifice 16 through which the paper towels (not shown) are conveniently dispensed. Orifice 16 is typically approximately three (3) inches wide at its widest point. The width of a standard paper towel, when folded and stored in a typical paper towel dispenser, is approximately three-and-one-quarter (3¼) inches. Therefore, almost the entire paper towel surface is exposed at the widest opening of orifice 16.

Figure 2:
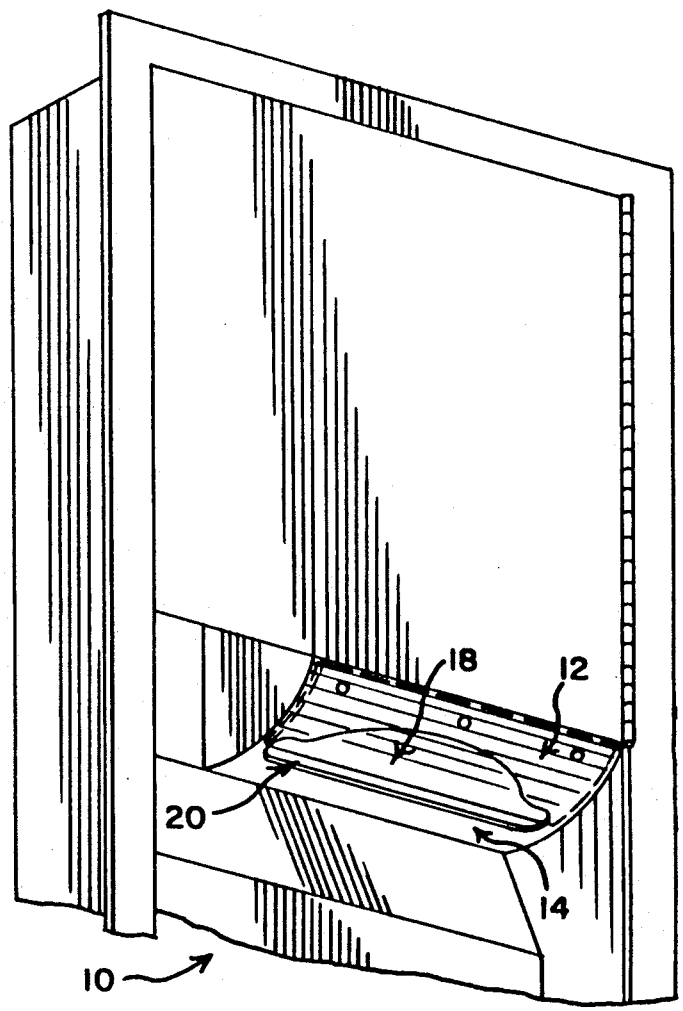
FIG. 2 is a perspective view of the paper towel dispenser of FIG. 1 retrofitted according to the present invention.

FIG. 2 illustrates a perspective view of the dispenser 10 of FIG. 1 retrofitted in accordance with the present invention. As previously explained, the dispenser section 15 includes front member 12 and back member 14. The dispensing section 15 further includes an interior surface 21 and an exterior surface 23 shown best in FIG. 3. The interior surface 21 typically provides the support for the stack of paper towels. The exterior surface 23 is exposed to the user.

Retrofit 18 is attached to the interior surface 21 of dispensing section 15, either at front member 12, back member 14, or both. Retrofit 18 covers a substantial portion of existing orifice 16 (shown in FIG. 1) forming a new narrowed orifice 20. New narrowed orifice 20 is preferably of uniform width with an opening of approximately three quarters (¾) inches. Thus retrofit 18, when properly attached to dispenser 10, has reduced the width of existing dispensing orifice 16 by over 75%.

Figure 3:
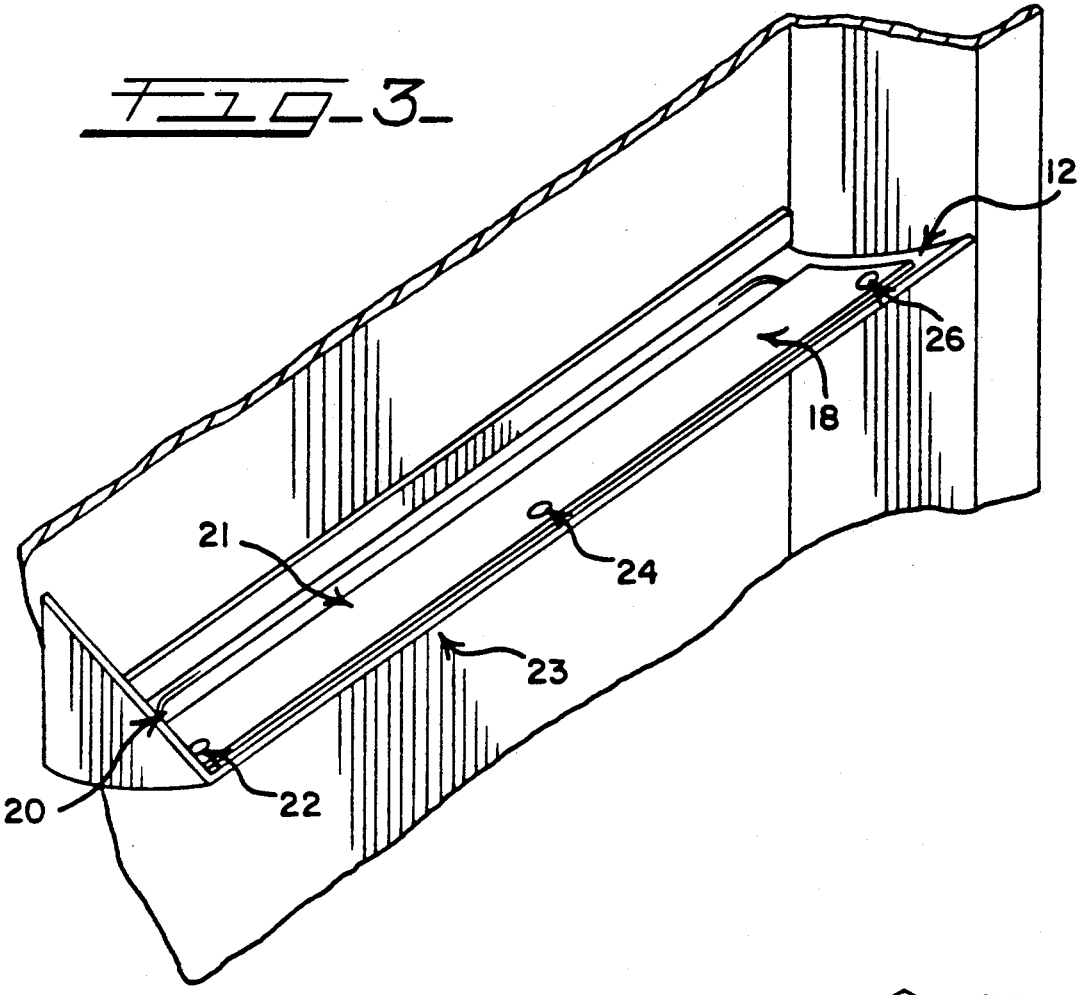
FIG. 3 is a perspective view illustrating the attachment of the retrofit in accordance with the present invention.

FIG. 3 is a perspective view illustrating the attachment of retrofit 18 in accordance with the present invention. Retrofit 18 is shown attached to the interior surface of front member 12, though as noted above, other attachments are possible. Thus, although retrofit 18 has been attached to front member 12, it could just as easily have been attached to back member 14.

Retrofit 18 is preferably rivoted at points 22, 24 and 26. This invention, however, is not limited to attaching retrofit 18 by rivots or at the points depicted. Retrofit 18 can be attached by numerous other methods. For example, it can be slid in so that its edges fit snugly against the sides of the dispenser; or it can be nailed, screwed or welded to front member 12 or back member 14. A person skilled in the art would know of many ways to attach retrofit 18 to the existing dispenser.

Figure 4:
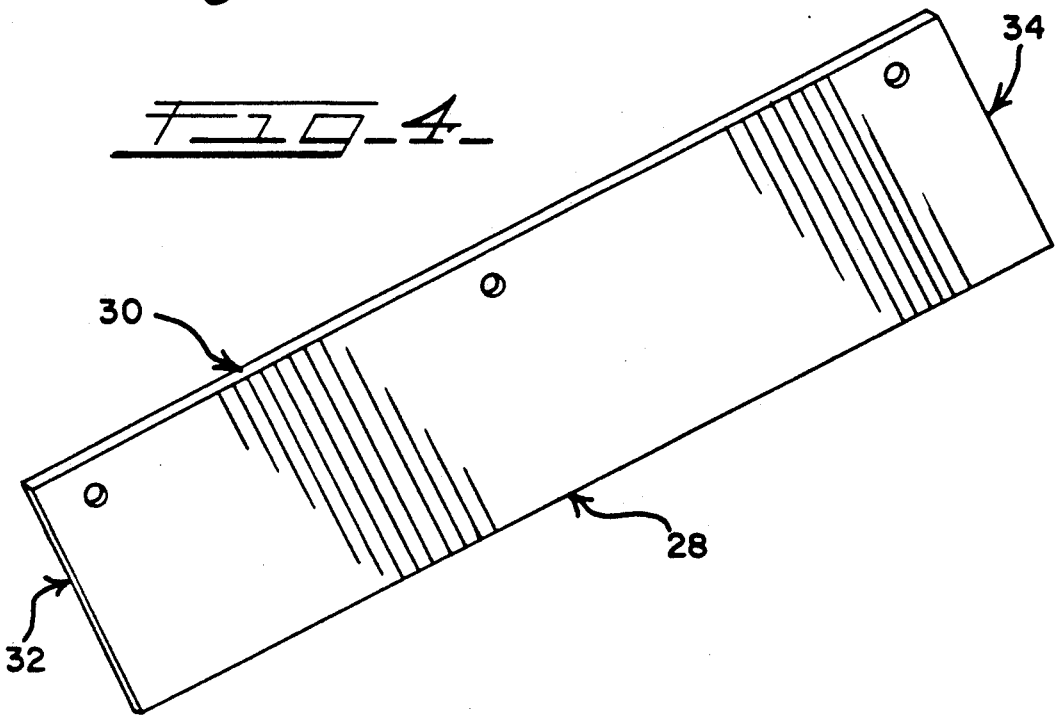
FIG. 4 is a perspective view of the retrofit in accordance with the present invention.

FIG. 4 illustrates retrofit 18. It is preferably rectangular in shape to fit most existing dispensers, although it can be formed in any shape so long as it fits the dispenser and narrows dispensing orifice 16 (shown in FIG. 1). In the preferred embodiment, retrofit 18 has a forward edge 28, a rear edge 30, and a pair of side edges 32 and 34. Retrofit 18 is mounted so that the existing dispensing orifice 16 is narrowed to a length less than the distance between side edges 32 and 34. The width of existing dispensing orifice 16 is preferably narrowed to less than one inch extending between forward edge 28 of retrofit 18 and back member 14 of the dispensing section. Retrofit 18 may be constructed from a hard plastic, metal or any other sturdy material.

With a narrower dispensing orifice, all the advantages previously described are achieved.

While this invention has been shown and described in connection with a particular preferred embodiment, it is apparent that certain changes and modifications, in addition to those mentioned above, may be made by those who are skilled in the art without departing from the basic scope of the present invention. Accordingly, all such changes and modifications are intended to be covered by the appended claims.

What is claimed is:

1. A retrofitted paper towel dispenser comprising:

a dispensing section wherein said section has a front member and a back member;

a dispensing orifice defined by said front and back members;

a retrofit having a forward edge, a rear edge and a pair of side edges;

means for mounting said retrofit to said dispensing section so that said dispensing orifice is narrowed to a restricted orifice, said restricted orifice defined by said forward edge of said retrofit and said back member of said dispensing section.

2. A dispenser according to claim 1 wherein said means for mounting said retrofit comprises a plurality of fastening members.

3. A dispenser according to claim 1 wherein said forward edge of said retrofit and said back member of said dispensing section support the towels.

4. A dispenser according to claim 1 wherein said dispensing section has an interior and an exterior surface, said retrofit mounted adjacently to said interior surface of said dispensing orifice

5. A dispenser according to claim 1 wherein said restricted orifice is less than one inch in width.

6. A dispenser according to claim 1 wherein said front member is above said back member.

7. A method for retrofitting a paper towel dispenser, said dispenser having a dispensing section defined by a front and a back member forming an orifice through which paper towels are dispensed, comprising the following steps:

inserting a retrofit in said dispensing section, said retrofit having a forward edge, a rear edge and a pair of side edges; and mounting said retrofit to said front member thereby narrowing said dispensing orifice, to create a restricted orifice, said restricted orifice defined by said forward edge of said retrofit and said back member of said dispensing section.

8. A method according to claim 7 further includes the steps of:

forming a plurality of alignable mounting holes in said retrofit and said front member of dispensing section;

aligning corresponding ones of said mounting holes in said retrofit and said front member; and inserting rigid fastening members through said holes to firmly secure to said retrofit to said dispensing orifice.

* * * * *

UNITED STATES PATENT AND TRADEMARK OFFICE

CERTIFICATE OF CORRECTION

PATENT NO. : 5,074,430

DATED : December 24, 1991

INVENTOR(S) : William C. Roberts

It is certified that error appears in the above-identified patent and that said Letters Patent is hereby corrected as shown below:

IN THE CLAIMS

Col. 4, claim 4, line 15, after "orifice" insert

--.--.

Signed and Sealed this

Twelfth Day of April, 1994

*Attest:*

*Attesting Officer*

BRUCE LEHMAN

*Commissioner of Patents and Trademarks*